US009107453B2

(12) United States Patent
Dube et al.

(10) Patent No.: US 9,107,453 B2
(45) Date of Patent: Aug. 18, 2015

(54) TOBACCO-DERIVED CASING COMPOSITION

(75) Inventors: Michael Francis Dube, Winston-Salem, NC (US); William Monroe Coleman, III, Winston-Salem, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 1239 days.

(21) Appl. No.: 13/015,744

(22) Filed: Jan. 28, 2011

(65) Prior Publication Data

US 2012/0192880 A1 Aug. 2, 2012

(51) Int. Cl.
*A24B 15/24* (2006.01)
*A24B 15/30* (2006.01)

(52) U.S. Cl.
CPC ..... *A24B 15/302* (2013.01); *A24B 15/24* (2013.01)

(58) Field of Classification Search
USPC ..... 131/274, 275, 290, 297, 347, 352, 359, 131/360, 366; 546/279.4; 549/398, 490
See application file for complete search history.

(56) References Cited

U.S. PATENT DOCUMENTS

| | | | | | |
|---|---|---|---|---|---|
| 1,376,586 | A | | 5/1921 | Schwartz | |
| 2,293,954 | A | * | 8/1942 | Tiger et al. | 546/279.4 |
| 3,419,015 | A | | 12/1968 | Wochnowski | |
| 3,424,171 | A | | 1/1969 | Rooker | |
| 3,476,118 | A | | 11/1969 | Luttich | |
| 4,054,145 | A | | 10/1977 | Berndt et al. | |
| 4,150,677 | A | | 4/1979 | Osborne, Jr. et al. | |
| 4,182,349 | A | * | 1/1980 | Selke | 131/374 |
| 4,244,381 | A | * | 1/1981 | Lendvay | 131/353 |
| 4,347,855 | A | | 9/1982 | Lanzellotti et al. | |
| 4,449,541 | A | | 5/1984 | Mays et al. | |
| 4,506,682 | A | * | 3/1985 | Muller | 131/297 |
| 4,513,756 | A | | 4/1985 | Pittman et al. | |
| 4,528,993 | A | | 7/1985 | Sensabaugh, Jr. et al. | |
| 4,624,269 | A | | 11/1986 | Story et al. | |
| 4,660,577 | A | | 4/1987 | Sensabaugh et al. | |
| 4,819,668 | A | | 4/1989 | Shelar et al. | |
| 4,850,749 | A | | 7/1989 | Sweeney | |
| 4,887,619 | A | | 12/1989 | Burcham et al. | |
| 4,941,484 | A | * | 7/1990 | Clapp et al. | 131/297 |
| 4,986,286 | A | | 1/1991 | Roberts et al. | |
| 4,987,907 | A | | 1/1991 | Townend | |
| 4,991,599 | A | | 2/1991 | Tibbetts | |
| 5,022,416 | A | | 6/1991 | Watson | |
| 5,060,676 | A | | 10/1991 | Hearn et al. | |
| 5,074,319 | A | | 12/1991 | White et al. | |
| 5,092,352 | A | | 3/1992 | Sprinkle, III et al. | |
| 5,099,862 | A | | 3/1992 | White et al. | |
| 5,103,842 | A | | 4/1992 | Strange et al. | |
| 5,143,097 | A | | 9/1992 | Stephen Sohn et al. | |
| 5,148,821 | A | | 9/1992 | Best et al. | |
| 5,159,942 | A | | 11/1992 | Brinkley et al. | |
| 5,235,992 | A | | 8/1993 | Sensabaugh, Jr. | |
| 5,301,694 | A | | 4/1994 | Raymond et al. | |
| 5,383,479 | A | | 1/1995 | Winterson et al. | |
| 5,387,416 | A | | 2/1995 | White et al. | |
| 5,598,868 | A | | 2/1997 | Jakob et al. | |
| 5,711,320 | A | | 1/1998 | Martin | |
| 5,715,844 | A | | 2/1998 | Young et al. | |
| 5,724,998 | A | | 3/1998 | Gellatly et al. | |
| 6,048,404 | A | | 4/2000 | White | |
| 6,216,706 | B1 | | 4/2001 | Kumar et al. | |
| 6,298,858 | B1 | | 10/2001 | Coleman, III et al. | |
| 6,325,860 | B1 | | 12/2001 | Coleman, III et al. | |
| 6,428,624 | B1 | | 8/2002 | Coleman, III et al. | |
| 6,440,223 | B1 | | 8/2002 | Dube et al. | |
| 6,499,489 | B1 | | 12/2002 | Coleman, III | |
| 6,591,841 | B1 | | 7/2003 | White et al. | |
| 6,668,839 | B2 | * | 12/2003 | Williams | 131/352 |
| 6,895,974 | B2 | | 5/2005 | Peele | |
| 6,953,040 | B2 | | 10/2005 | Atchley et al. | |
| 7,025,066 | B2 | | 4/2006 | Lawson et al. | |
| 7,032,601 | B2 | | 4/2006 | Atchley et al. | |
| 7,694,686 | B2 | | 4/2010 | Atchley et al. | |
| 7,798,153 | B2 | | 9/2010 | Lawrence, Jr. | |
| 7,810,507 | B2 | | 10/2010 | Dube et al. | |
| 7,819,124 | B2 | | 10/2010 | Strickland et al. | |
| 7,861,728 | B2 | | 1/2011 | Holton, Jr. et al. | |
| 2002/0162562 | A1 | | 11/2002 | Williams | |
| 2004/0020503 | A1 | | 2/2004 | Williams | |
| 2004/0173228 | A1 | | 9/2004 | Coleman, III | |
| 2005/0115580 | A1 | | 6/2005 | Quinter et al. | |
| 2005/0244521 | A1 | | 11/2005 | Strickland et al. | |
| 2006/0191548 | A1 | | 8/2006 | Strickland et al. | |
| 2007/0062549 | A1 | | 3/2007 | Holton, Jr. et al. | |
| 2007/0193596 | A1 | * | 8/2007 | Mori et al. | 131/347 |
| 2008/0173317 | A1 | | 7/2008 | Robinson et al. | |
| 2008/0196730 | A1 | | 8/2008 | Engstrom et al. | |
| 2008/0245377 | A1 | | 10/2008 | Marshall et al. | |
| 2009/0065013 | A1 | | 3/2009 | Essen et al. | |
| 2009/0293889 | A1 | | 12/2009 | Kumar et al. | |
| 2010/0018540 | A1 | | 1/2010 | Doolittle et al. | |
| 2010/0018541 | A1 | | 1/2010 | Gerardi et al. | |
| 2010/0037903 | A1 | | 2/2010 | Coleman, III et al. | |
| 2010/0116281 | A1 | | 5/2010 | Marshall et al. | |
| 2010/0291245 | A1 | | 11/2010 | Gao et al. | |

FOREIGN PATENT DOCUMENTS

| | | | |
|---|---|---|---|
| GB | 2075373 | A | 11/1981 |
| WO | WO 2004/095959 | A1 | 11/2004 |
| WO | WO 2005/041699 | A2 | 5/2005 |
| WO | WO 2005/063060 | A1 | 7/2005 |
| WO | WO 2010/132444 | A2 | 11/2010 |

* cited by examiner

*Primary Examiner* — Dennis Cordray
(74) *Attorney, Agent, or Firm* — Womble Carlyle Sandridge & Rice, LLP

(57) ABSTRACT

The invention provides a tobacco composition for use in a smoking article or a smokeless tobacco composition that comprises an extract derived from a component of a plant of the *Nicotiana* species. The invention also provides smoking articles and smokeless tobacco compositions that include the extracts described herein, and methods for preparing extracts derived from a component of a plant of the *Nicotiana* species for addition to a tobacco composition.

19 Claims, 2 Drawing Sheets

TOBACCO-DERIVED CASING COMPOSITION

FIELD OF THE INVENTION

The present invention relates to products made or derived from tobacco, or that otherwise incorporate tobacco, and are intended for human consumption.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999).

Tobacco also may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. No. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; and 2010/0291245 to Gao et al; PCT WO 04/095959 to Arnarp et al. and WO 2010/132444 A2 to Atchley; and U.S. patent application Ser. No. 12/638,394, filed Dec. 15, 2009, to Mua et al.; each of which is incorporated herein by reference.

Through the years, various treatment methods and additives have been proposed for altering the overall character or nature of tobacco materials utilized in tobacco products. For example, additives or treatment processes have been utilized in order to alter the chemistry or sensory properties of the tobacco material, or in the case of smokable tobacco materials, to alter the chemistry or sensory properties of mainstream smoke generated by smoking articles including the tobacco material. The sensory attributes of cigarette smoke can be enhanced by incorporating flavoring materials into various components of a cigarette. Exemplary flavoring additives include menthol and products of Maillard reactions, such as pyrazines, aminosugars, and Amadori compounds. American cigarette tobacco blends typically contain a casing composition that includes flavoring ingredients, such as licorice or cocoa powder and a sugar source such as high fructose corn syrup. See also, Leffingwell et al., *Tobacco Flavoring for Smoking Products*, R.J. Reynolds Tobacco Company (1972), which is incorporated herein by reference. Various processes for preparing flavorful and aromatic compositions for use in tobacco compositions are set forth in U.S. Pat. No. 3,424,171 to Rooker; U.S. Pat. No. 3,476,118 to Luttich; U.S. Pat. No. 4,150,677 to Osborne, Jr. et al.; U.S. Pat. No. 4,986,286 to Roberts et al.; U.S. Pat. No. 5,074,319 to White et al.; U.S. Pat. No. 5,099,862 to White et al.; U.S. Pat. No. 5,235,992 to Sensabaugh, Jr.; U.S. Pat. No. 5,301,694 to Raymond et al.; U.S. Pat. No. 6,298,858 to Coleman, III et al.; U.S. Pat. No. 6,325,860 to Coleman, III et al.; U.S. Pat. No. 6,428,624 to Coleman, III et al.; U.S. Pat. No. 6,440,223 to Dube et al.; U.S. Pat. No. 6,499,489 to Coleman, III; and U.S. Pat. No. 6,591,841 to White et al.; US Pat. Appl. Pub. Nos. 2004/0173228 to Coleman, III and 2010/0037903 to Coleman, III et al., each of which is incorporated herein by reference.

The sensory attributes of smokeless tobacco can also be enhanced by incorporation of certain flavoring materials. See, for example, US Pat. Appl. Pub. Nos. 2002/0162562 to Williams; 2002/0162563 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Neilsen et al., each of which is incorporated herein by reference.

It would be desirable to provide additional compositions and methods for altering the character and nature of tobacco (and tobacco compositions and formulations) useful in the manufacture of smoking articles and/or smokeless tobacco products. Specifically, it would be desirable to develop compositions and methods for altering the character and nature of tobacco compositions and formulations using tobacco-derived flavorful materials.

SUMMARY OF THE INVENTION

The present invention provides a flavorful composition isolated from the *Nicotiana* species (i.e., a tobacco-derived composition) useful for incorporation into tobacco compositions utilized in a variety of tobacco products, such as smoking articles and smokeless tobacco products. The invention also provides methods for isolating components from the *Nicotiana* species (e.g., tobacco materials), methods for processing those components, and tobacco materials incorporating those components. In particular, the invention provides tobacco-derived powders that can be used as flavorful tobacco compositions and methods for isolating and forming such powders. The tobacco-derived powders can be isolated, for example, by grinding and drying at least a portion of a tobacco plant (e.g., leaves, stalks, roots, or stems) and purifying the resulting powder in order to isolate desired flavorful components of the tobacco material.

In one aspect, the invention provides a flavorful tobacco composition for use in a tobacco product in the form of an extract derived from the stalk or root of a plant of the *Nicotiana* species. The extract can be in a variety of forms, such as in liquid or powder form. In some embodiments, the extract is contained within a casing formulation or a top dressing formulation adapted for application to a tobacco material.

The tobacco composition may comprise an extract derived from the stalk of a plant of the *Nicotiana* species or an extract derived from the root of a plant of the *Nicotiana* species. In some embodiments, the composition can comprise both material derived from the stalk and material derived from the root of a plant of the *Nicotiana* species.

The components of the extract can vary. For example, in certain embodiments, the extract comprises one or more compounds selected from the group consisting of vanillin, syringaldehyde, C2 pyrazines, C3 pyrazines, acetic acid, dihydro-2-methyl-3-furanone, furanethanolacetate, furanmethanol, maltol, 3-hydroxypyridine, 5-methylfurfural, hexanal, pentylfuran, nonanal, decanal, menthol, 3-methylpentanoic acid, 2-hydroxy-3-methyl-2-cyclopenten-1-one, 3-hydroxypyridine, and 2,6-dimethoxyphenol.

In another aspect of the present invention is provided a tobacco product comprising a flavorful tobacco composition in the form of an extract derived from the stalk or root of a plant of the *Nicotiana* species; In certain embodiments, the tobacco product further comprises a tobacco material or a non-tobacco plant material as a carrier for the extract. The tobacco product can be, for example, in the form of a smokeless tobacco composition. In some embodiments, the smokeless tobacco composition can be in the form of moist snuff, dry snuff, chewing tobacco, tobacco-containing gums, or dissolvable or meltable tobacco products. The tobacco product can be, for example, in the form of a smoking article. In some embodiments, the smoking article comprises a casing formulation or a top dressing comprising the extract. The tobacco product can be, for example, in the form of an aerosol-generating device configured for non-combustion of plant material.

The tobacco product can comprise an extract derived from the stalk of a plant of the *Nicotiana* species or an extract derived from the root of a plant of the *Nicotiana* species. In some embodiments, the composition can comprise both material derived from the stalk and material derived from the root of a plant of the *Nicotiana* species.

In another aspect of the present invention is provided a method for preparing a flavorful composition from the stalk or roots of a plant of the *Nicotiana* species, comprising:

i) receiving a particulate tobacco material comprising at least one of the stalk material and the root material of a harvested plant of the *Nicotiana* species;

ii) extracting water-soluble components from the particulate tobacco material to form an aqueous extract; and iii) concentrating the aqueous extract to provide a flavorful tobacco composition suitable for use as in a tobacco product.

In some embodiments, the particulate tobacco material employed in the method comprises tobacco stalk material or tobacco root material separated from the remainder of the tobacco plant. In some embodiments, the received particulate tobacco material is formed by grinding at least one of the stalk material and the root material of a harvested plant of the *Nicotiana* species to form a particulate material. In some embodiments, the extracting step comprises contacting the stalk or roots with an aqueous solvent to form a moist tobacco material, heating the moist tobacco material at an elevated temperature, and separating the aqueous extract from an insoluble portion of the moist tobacco material.

The extracting step may be conducted at any temperature and pressure. In certain embodiments, the extracting step is conducted at a pressure exceeding atmospheric pressure. In certain embodiments, the extracting step comprises filtering the aqueous extract to remove insoluble solid components of the particulate tobacco material. For example, the filtering can comprise exposing the aqueous component to an ultrafiltration membrane. In certain embodiments, the concentrating step comprises heating the aqueous extract.

In some embodiments, the method further comprises adding the aqueous extract to a tobacco material or a non-tobacco plant material as a carrier for the aqueous extract. The tobacco material or non-tobacco plant material can, in certain embodiments, be incorporated into a tobacco product. The tobacco product can be, for example, in the form of a smokeless tobacco composition. The form of the smokeless tobacco composition can vary; for example, the form can be selected from the group consisting of moist snuff, dry snuff, chewing tobacco, tobacco-containing gums, and dissolvable or meltable tobacco products. The tobacco product can be, for example, in the form of a smoking article. In some embodiments, the smoking article comprises a casing formulation or a top dressing comprising the extract.

In another aspect of the present invention is provided a method for preparing a flavorful composition from the stalk or roots of a plant of the *Nicotiana* species, comprising:

i) receiving a particulate tobacco material comprising at least about 90 percent by dry weight of at least one of the stalk material and the root material of a harvested plant of the Nicotiana species;

ii) mixing an aqueous solvent with the particulate tobacco material to form a moist tobacco material;

iii) heating the moist tobacco material to an elevated temperature to extract flavorful components therefrom;

iv) separating an aqueous-insoluble portion of the moist tobacco material to form an isolated aqueous extract; and v) concentrating the aqueous extract to provide a flavorful tobacco composition suitable for use as in a tobacco product.

The conditions used for the various steps in this method can vary. In certain embodiments, the concentrating step comprises evaporating sufficient aqueous solvent to form a solid material suitable for incorporation into a tobacco product in powder form. In some embodiments, the received particulate tobacco material is formed by grinding at least one of the stalk material and the root material of a harvested plant of the *Nicotiana* species to form a particulate material. In some embodiments, the moist tobacco material is in the form of a slurry or suspension. In some embodiments, the heating step is conducted at a temperature of at least about 50° C. In some embodiments, the separating step comprises at least one of filtration and centrifugation.

BRIEF DESCRIPTION OF THE DRAWINGS

In order to provide an understanding of embodiments of the invention, reference is made to the appended drawings, which are not necessarily drawn to scale, and in which reference numerals refer to components of exemplary embodiments of the invention. The drawings are exemplary only, and should not be construed as limiting the invention.

DETAILED DESCRIPTION OF THE PREFERRED EMBODIMENTS

Figure 1:
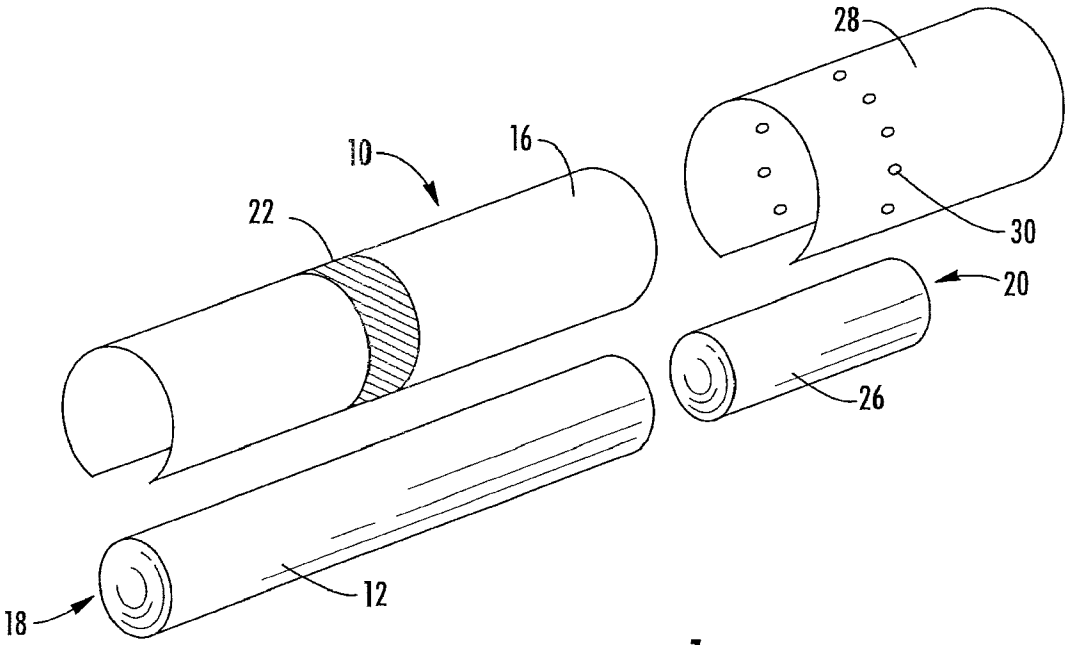
FIG. 1 is an exploded perspective view of a smoking article having the form of a cigarette, showing the smokable material, the wrapping material components, and the filter element of the cigarette.

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The present invention provides a flavorful extract derived from a plant of the *Nicotiana* species or a portion or component thereof, such as the stalks and/or roots of the plant. The extract can be in a variety of forms, including powder form. The powder provides a tobacco-derived material that can be used as a flavorful tobacco composition in a variety of tobacco products. In one embodiment, the tobacco-derived powder materials of the invention are used as a replacement for certain non-tobacco flavorings commonly used in cigarettes, such as cocoa powder and/or licorice powder. As used herein, a "tobacco-derived powder" refers to a material in powder form obtained or derived from a plant from the *Nicotiana* species, particularly the stalks and/or roots of the plant.

Preparation of a powder according to the present invention comprises harvesting a plant from the *Nicotiana* species and, in certain embodiments, separating certain components from the plant such as the stalks and/or roots, and physically processing these components. Although whole tobacco plants or any component thereof (e.g., leaves, flowers, stems, roots, stalks, and the like) could be used in the invention, it is advantageous to use stalks and/or roots of the tobacco plant. The remainder of the description focuses on use of stalks and/or roots from the plant, but the invention is not limited to such embodiments.

The tobacco stalks and/or roots can be separated into individual pieces (e.g., roots separated from stalks, and/or root parts separated from each other, such as big root, mid root, and small root parts) or the stalks and roots may be combined. By "stalk" is meant the stalk that is left after the leaf (including stem and lamina) has been removed. "Root" and various specific root parts useful according to the present invention may be defined and classified as described, for example, in Mauseth, Botany: An Introduction to Plant Biology: Fourth Edition, Jones and Bartlett Publishers (2009) and Glimn-Lacy et al., Botany Illustrated, Second Edition, Springer (2006), which are incorporated herein by reference. The harvested stalks and/or roots are typically cleaned, ground, and dried to produce a material that can be described as particulate (i.e., shredded, pulverized, ground, granulated, or powdered).

Although the particulate material may comprise material from any part of a plant of the *Nicotiana* species, the majority of the material typically comprises material obtained from the stalks and/or roots of the plant. For example, in certain embodiments, the particulate material comprises at least about 90%, at least about 92%, at least about 95%, or at least about 97% by dry weight of at least one of the stalk material and the root material of a harvested plant of the *Nicotiana* species.

Preferably, the physical processing step comprises comminuting, grinding, and/or pulverizing stalks and/or roots from a *Nicotiana* plant into particulate form using equipment and techniques for grinding, milling, or the like. In certain preferred embodiments, the stalks and/or roots are dried prior to the physical processing step, and thus are relatively dry in form during grinding or milling. For example, the stalks and/or roots can be ground or milled when the moisture content thereof is less than about 15 weight percent or less than about 5 weight percent. In such embodiments, equipment such as hammer mills, cutter heads, air control mills, or the like may be used. The manner by which the stalks and/or roots are provided in such a form can vary.

For example, material obtained from *Nicotiana* plant stalks can be isolated and treated separately from material obtained from *Nicotiana* plant roots. Material from various parts of the stalks and/or roots can be isolated and treated separately (for example, material derived from different parts of the root can be kept separate throughout the processing). In some embodiments, material from different parts of the *Nicotiana* plant can be combined and processed together, thereby forming a single homogenous powder. In some embodiments, material from different parts of the *Nicotiana* plant are isolated and treated separately and combined at some stage of the processing to give a single powder product.

The particulate material provided following the comminuting, grinding, and/or pulverizing of *Nicotiana* stalks and/or roots can have any grain size. The particulate material can be such that parts or pieces thereof have an average particle size between about 25 microns and about 5 mm. In some embodiments, the average particle size of the particulate material is less than or equal to about 5 mm, less than or equal to about 2 mm, less than or equal to about 1 mm, less than or equal to about 500 microns, or less than or equal to about 100 microns.

In certain embodiments, the particulate or powder material is treated with water to extract an aqueous soluble component of the powder therefrom. In some preferred embodiments, the particulate or powder material is combined with water to form a moist aqueous material (e.g., in the form of a suspension or slurry) and the resulting material is typically heated to effectuate extraction of various compounds. The water used to form the moist material can be pure water (e.g., tap water or deionized water) or a mixture of water with suitable co-solvents such as certain alcohols. In certain embodiments, the amount of water added to form the moist material can be at least about 50 weight percent, or at least about 60 weight percent, or at least about 70 weight percent, based on the total weight of the moist material. In some cases, the amount of water can be described as at least about 80 weight percent or at least about 90 weight percent.

The heating of the moist material can be conducted at various temperatures and pressures. In certain embodiments, the moist material is heated to elevated temperatures (e.g., above room temperature) to effect extraction of compounds in the particulate material. For example, the moist material can be heated to greater than about 50° C., greater than about 60° C., greater than about 70° C., greater than about 80° C., greater than about 90° C., greater than about 100° C., greater than about 125° C., greater than about 150° C., greater than about 175° C., or greater than about 200° C. In certain embodiments, the pressure and temperature are adjusted such that the temperature of the moist material is elevated compared to the boiling point of water at atmospheric pressure. In other words, in some embodiments, it is advantageous to heat the moist material under pressure so that the temperature of the material during heating exceeds the boiling point of water at atmospheric pressure (i.e., exceeds about 100° C.). One of skill in the art will be aware that the boiling point of a liquid is related to its pressure, and therefore will be able to adjust the pressure and temperature accordingly to cause boiling of the moist material.

The heating is typically conducted in a pressure-controlled and pressurized environment, although atmospheric pressure in a vented tank can be used without departing from the invention. Such a pressurized environment is provided, for example, by enclosing the aqueous reaction mixture in an air-sealed vessel or chamber. Examples of vessels that provide a pressure-controlled environment include a high pressure autoclave from Berghof/America Inc. of Concord, Calif., and Parr Reactor Model Nos. 4522 and 4552 available from The Parr Instrument Co. and described in U.S. Pat. No. 4,882,128 to Hukvari et al., as well as CEM Corporation Model XP-1500 and HP-500 pressure vessels. Operation of such exemplary vessels will be apparent to the skilled artisan. See, for example, U.S. Pat. No. 6,048,404 to White. Typical pressures experienced by the aqueous reaction mixture during the heating process often range from about 10 psig to about 1,000 psig, normally from about 20 psig to about 500 psig. Preferred pressure vessels are equipped with an external heating source, and can also be equipped with means for agitation, such as an impeller. In other embodiments, the heat treatment process is conducted using an enclosed container placed in a microwave oven, a convection oven, or heated by infrared heating.

Atmospheric air, or ambient atmosphere, is the preferred atmosphere for carrying out the present invention. However, heat treatment of the aqueous composition can also take place under a controlled atmosphere, such as a generally inert atmosphere. Gases such as nitrogen, argon and carbon dioxide can be used. Alternatively, a hydrocarbon gas (e.g., methane, ethane or butane) or a fluorocarbon gas also can provide at least a portion of a controlled atmosphere in certain embodiments, depending on the choice of treatment conditions and desired reaction products. The particulate matter can be contacted with water for any period of time to effectuate extraction of compounds therefrom. The amount of time required to effectuate substantial extraction is partially dependent on the temperature and pressure at which the extraction is conducted. For example, in some embodiments, heating the moist material to an elevated temperature and/or pressurizing the moist material increases the rate of extraction. The time range for the aqueous extraction process is typically at least about 30 minutes (e.g., at least about 1 hour or at least about 2 hours) and typically less than about 24 hours (e.g., less than about 12 hours or less than about 8 hours), although other time periods could be used without departing from the invention.

The extract thus produced may comprise some level of solid (insoluble) material entrained in the liquid. Accordingly, "extract" is intended to mean the material obtained upon contacting the stalks and/or roots with water and may comprise both soluble components dissolved therein and solid dispersed components. Following the extraction process, the extracted liquid component is typically filtered to remove at least some of the solids. In other words, some or all of the portion of the powder material insoluble in the aqueous solvent is removed. The process of filtration can comprise passing the liquid through one or more filter screens to remove selected sizes of particulate matter. Screens may be, for example, stationary, vibrating, rotary, or any combination thereof. Filters may be, for example, press filters or pressure filters. In some embodiments, the filtration method used can involve microfiltration, ultrafiltration, and/or nanofiltration. A filter aid can be employed to provide effective filtration and can comprise any material typically used for this purpose. For example, some common filter aids include cellulose fibers, perlite, bentonite, diatomaceous earth, and other silaceous materials. To remove solid components, alternative methods can also be used, for example, centrifugation or settling/sedimentation of the components and siphoning off of the liquid.

In one embodiment, the process of the invention involves processing the extracted liquid using an ultrafiltration technique. In ultrafiltration processing, the extracted liquid is exposed to a membrane having a pore size capable of excluding small molecular weight components, typically in a cross-flow arrangement. The pore size of membranes typically utilized in ultrafiltration can vary, but generally falls within the range of about 0.1 to about 0.001 micron. Ultrafiltration membranes can also be characterized by their nominal molecular weight limit (NMWL), which is an approximation of the upper limit of the molecular weight of species capable of passing through the membrane. For purposes of the present invention, the NMWL is typically between about 5,000 Da and about 75,000 Da. In one embodiment, the ultrafiltration process involves passing the extracted liquid through multiple ultrafiltration stages having different NMWL ratings. For example, the process could involve first processing the extracted liquid using a 50,000 Da ultrafiltration membrane and thereafter processing the liquid using a 5,000 Da ultrafiltration membrane. Although various types of ultrafiltration membranes can be used, a cellulose-based hollow fiber membrane is one advantageous choice. Such membranes are commercially available from Koch Membrane Systems, Inc. Use of ultrafiltration techniques are set forth, for example, in U.S. Pat. No. 4,941,484 to Clapp et al, which is incorporated by reference herein.

Following extraction and/or filtration, the liquid can be further processed if desired. For example, the liquid can be processed in a manner adapted to concentrate the dissolved or dispersed components of the liquid by removing at least a portion of the solvent (e.g., water). The concentration step removes water from the extracted aqueous liquid, which provides a powder having an increased concentration of various compounds.

Various methods of solvent removal can be used, such as heat treatment to evaporate the solvent, vacuum removal of the solvent, reverse osmosis membrane treatment, spray drying or freeze drying. In certain embodiments, the liquid can be heated at a pressure other than atmospheric, such as under a partial vacuum (thereby reducing the temperature required to boil the aqueous liquid) or at increased pressure above atmospheric pressure (thereby increasing the temperature required to boil the aqueous liquid). In one embodiment, the solvent removal is effectuated by slow evaporation at elevated temperature, such as a temperature of at least about 60° C. or at least about 80° C.

The resulting solid is typically provided in powder form. The powder can have any grain or particle size. For example, the powder may be such that parts or pieces thereof have an average particle size from about 25 microns to about 500 microns. In one embodiment, the average particle size of the particles is from about 50 to about 150 microns. In certain embodiments, the powder may be characterized as having, for example, an average particle size of less than about 500 microns, less than about 250 microns, less than about 150 microns, or less than about 100 microns. The powder can be used directly or can be further processed. For example, if desired, the solid can be subjected to separation processes adapted to separate various volatile flavor compounds contained therein into isolated fractions. For example, chromatographic techniques could be used to separate one or more compounds from the mixture present in the powder.

The yield of powder from the plant components can vary. For example, in certain embodiments, the yield of extracted powder material obtained is greater than about 10%, greater than about 15%, greater than about 20, or greater than about 25% based on the weight of the harvested stalk and/or root. Yield is dependent on a number of factors. For example, yield can depend on the quality of the tobacco plants. Poor quality plants/plant components or those that have been harvested very early or very late can comprise different amounts of extractable components. Yield can also depend on the efficiency of extraction. The efficiency of extraction is somewhat controlled by the extraction method and the specific equipment used. Yield can also vary as a result of the specific conditions used throughout the powder production process.

The exact composition of the powder produced according to the present invention can vary. The composition may depend, in part, on whether the powder is prepared from *Nicotiana* stalks, roots, or a combination thereof. Powders prepared according to the invention typically comprise flavorful compounds such as vanillin and syringaldehyde resulting from lignin degradation reactions occurring during the preparation of the extracts, and/or pyrazines (e.g., C2 pyrazines and/or C3 pyrazines) resulting from Maillard reactions between sugar compounds and nitrogen sources in the liquid. In some embodiments, other compounds that can be present in powders of the present invention include acetic acid, dihydro-2-methyl-3-furanone, furanethanolacetate, furanmethanol, maltol, 3-hydroxypyridine, 5-methylfurfural, hexanal, pentylfuran, nonanal, decanal, menthol, 3-methylpentanoic acid, 2-hydroxy-3-methyl-2-cyclopenten-1-one, 3-hydroxypyridine, and 2,6-dimethoxyphenol. The components of a powder prepared according to the present invention can be present in varying amounts, but flavor components are typically present in the microgram range.

Powders prepared solely from material obtained from *Nicotiana* stalks may exhibit different characteristics than powders prepared solely from material obtained from *Nicotiana* roots. Similarly, powders prepared from material obtained from certain parts of one of these components may exhibit different characteristics than material obtained from other parts of this component (e.g., powder prepared from mid-root material may be different from powder prepared from big root material). For example, in certain embodiments, powder derived from *Nicotiana* stalk has a higher content of volatile compounds than powder derived from *Nicotiana* root.

The selection of the plant from the *Nicotiana* species utilized in the process of the invention can vary; and in particular, the types of tobacco or tobaccos can vary. The type of tobacco used as the source of tobacco stalks and/or roots from which the powder is derived and as the carrier for the powder of the invention can vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos. Descriptions of various types of tobaccos, growing practices and harvesting practices are set forth in *Tobacco Production, Chemistry and Technology*, Davis et al. (Eds.) (1999), which is incorporated herein by reference. Various representative types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference.

The particular *Nicotiana* species of material used in the invention could also vary. Of particular interest are *N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata,* and *N.×sanderae*. Also of interest are *N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. rustica, N. simulans, N. stocktonii, N. suaveolens, N. tabacum, N. umbratica, N. velutina,* and *N. wigandioides*. Other plants from the *Nicotiana* species include *N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia* and *N. spegazzinii*. The *Nicotiana* species can be derived using genetic-modification or crossbreeding, techniques (e.g., tobacco plants can be genetically engineered or crossbred to increase or decrease production of certain components or to otherwise change certain characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al.; and U.S. Pat. No. 7,230,160 to Benning et al.; US Patent Appl. Pub. No. 2006/0236434 to Conkling et al.; and PCT WO 2008/103935 to Nielsen et al.

For the preparation of smokeless and smokable tobacco products, it is typical for harvested plants of the *Nicotiana* species to be subjected to a curing process. Descriptions of various types of curing processes for various types of tobaccos are set forth in *Tobacco Production, Chemistry and Technology*, Davis et al. (Eds.) (1999). Exemplary techniques and conditions for curing flue-cured tobacco are set forth in Nestor et al., *Beitrage Tabakforsch. Int,* 20, 467-475 (2003) and U.S. Pat. No. 6,895,974 to Peele, which are incorporated herein by reference. Representative techniques and conditions for air curing tobacco are set forth in Roton et al., *Beitrage Tabakforsch. Int,* 21, 305-320 (2005) and Staaf et al., *Beitrage Tabakforsch. Int,* 21, 321-330 (2005), which are incorporated herein by reference. Certain types of tobaccos can be subjected to alternative types of curing processes, such as fire curing or sun curing. Preferably, harvested tobaccos are cured and then aged.

The plant component or components from the *Nicotiana* species can be employed in an immature form. That is, the plant can be harvested before the plant reaches a stage normally regarded as ripe or mature. As such, for example, the plant can be harvested when the tobacco plant is at the point of a sprout, is commencing leaf formation, is commencing flowering, or the like.

The plant components from the *Nicotiana* species can be employed in a mature form. That is, the plant can be harvested when that plant reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position.

After harvest, the plant of the *Nicotiana* species, or portion thereof, can be used in a green form (e.g., tobacco can be used without being subjected to any curing process). For example, tobacco in green form can be frozen, freeze-dried, subjected to irradiation, yellowed, dried, cooked (e.g., roasted, fried or boiled), or otherwise subjected to storage or treatment for later use. Such tobacco also can be subjected to aging conditions.

Powders generated according to the process of the invention are useful as flavorful materials for tobacco compositions, particularly tobacco compositions incorporated into smoking articles or smokeless tobacco products. In accordance with the present invention, a tobacco product incorporates tobacco that is combined with a tobacco-derived powder according to the invention. That is, a portion of the tobacco product can be comprised of some form of powder prepared according to the invention. Addition of the powder to a tobacco composition can enhance a tobacco composition in a variety of ways, depending on the nature of the powder generated and the type of tobacco composition. Exemplary powder compositions can serve to provide flavor and/or aroma to a tobacco product (e.g., the composition can alter the sensory characteristics of tobacco compositions or smoke derived therefrom). Given the pleasing aroma of the powder materials of the invention and the confirmed content of certain known volatile flavor compounds, in one embodiment, the powder is utilized in the casing of a cigarette to add flavor typically derived from one or more of the traditional components of a cigarette casing, particularly flavorful components such as licorice powder and/or cocoa powder.

The powder can be employed in a variety of forms. The powder can be used directly, i.e., in solid form. The powder can be dissolved and/or dispersed within a solvent and employed in a liquid form and as such, the content of tobacco solubles within the liquid solvent can be controlled by concentration of the solution by removal of solvent, addition of solvent to dilute the solution, or the like.

The tobacco product to which the powders of the invention are added can vary, and can include any product configured or adapted to deliver tobacco or some component thereof to the user of the product. Exemplary tobacco products include smoking articles (e.g., cigarettes), smokeless tobacco products, and aerosol-generating devices that contain a tobacco material or other plant material that is not combusted during use. The incorporation of the powders of the invention into a tobacco product may involve use of a tobacco material or non-tobacco plant material as a carrier for the powder, such as by dissolving the powder and absorbing the solution into the tobacco or other plant material or otherwise associating the powder with the carrier material. The types of tobacco that can serves as the carrier for the powders of the invention can vary, and can include any of the tobacco types discussed herein, including various cured tobacco materials (e.g., flue-cured or air-cured tobaccos) or portions thereof (e.g., tobacco lamina or tobacco stems). The physical configuration of the tobacco material to which the powder is added can also vary, and can include tobacco materials in shredded or particulate form, or in the form of a sheet (e.g., reconstituted tobacco sheets) or in whole leaf form.

In one embodiment, the powders of the invention are used as a flavorful tobacco composition in the manufacture of smoking articles. There are various methods by which the powders may be incorporated into casings and applied to tobacco. For example, the extracts may be applied to casing composition by way of a liquid formulation that may comprise both soluble and dispersible components. For exemplary means by which extracts of the present invention may be incorporated into casings and applied to tobacco, see, for example, U.S. Pat. No. 3,419,015 to Wochnowski; U.S. Pat. No. 4,054,145 to Berndt et al.; U.S. Pat. No. 4,449,541 to Mays et al.; U.S. Pat. No. 4,819,668 to Shelar et al.; U.S. Pat. No. 4,850,749 to Sweeney; U.S. Pat. No. 4,887,619 to Burcham et al.; U.S. Pat. No. 5,022,416 to Watson; U.S. Pat. No. 5,103,842 to Strang et al.; U.S. Pat. No. 5,383,479 to Winterson et al.; and U.S. Pat. No. 5,711,320 to Martin and UK Patent No. 2075375 to Hauni, which are incorporated herein by reference.

In other embodiments, the powders of the invention can be incorporated into smoking articles as a top dressing ingredient or incorporated into reconstituted tobacco materials (e.g., using the types of tobacco reconstitution processes generally set forth in U.S. Pat. No. 5,143,097 to Sohn; U.S. Pat. No. 5,159,942 to Brinkley et al.; U.S. Pat. No. 5,598,868 to Jakob; U.S. Pat. No. 5,715,844 to Young; U.S. Pat. No. 5,724,998 to Gellatly; and U.S. Pat. No. 6,216,706 to Kumar, which are incorporated herein by reference). Still further, the powders of the invention can be incorporated into a cigarette filter (e.g., in the filter plug, plug wrap, or tipping paper) or incorporated into cigarette wrapping paper, preferably on the inside surface, during the cigarette manufacturing process.

Referring to FIG. 1, there is shown a smoking article 10 in the form of a cigarette and possessing certain representative components of a smoking article that can contain the powder of the present invention. The cigarette 10 includes a generally cylindrical rod 12 of a charge or roll of smokable filler material (e.g., about 0.3 to about 1.0 g of smokable filler material such as tobacco material) contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. The band 22 can be printed on the inner surface of the wrapping material (i.e., facing the smokable filler material), or less preferably, on the outer surface of the wrapping material.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough. A plug wrap 28 enwraps the filter element and a tipping material (not shown) enwraps the plug wrap and a portion of the outer wrapping material 16 of the rod 12, thereby securing the rod to the filter element 26.

A ventilated or air diluted smoking article can be provided with an optional air dilution means, such as a series of perforations 30, each of which extend through the tipping material and plug wrap. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper).

The powder of the invention can also be incorporated into aerosol-generating devices that contain tobacco material (or some portion or component thereof) that is not intended to be combusted during use. Exemplary references that describe smoking articles of a type that generate flavored vapor, visible aerosol, or a mixture of flavored vapor and visible aerosol, include U.S. Pat. No. 3,258,015 to Ellis et al.; U.S. Pat. No. 3,356,094 to Ellis et al.; U.S. Pat. No. 3,516,417 to Moses; U.S. Pat. No. 4,347,855 to Lanzellotti et al.; U.S. Pat. No. 4,340,072 to Bolt et al.; U.S. Pat. No. 4,391,285 to Burnett et al.; U.S. Pat. No. 4,917,121 to Riehl et al.; U.S. Pat. No. 4,924,886 to Litzinger; and U.S. Pat. No. 5,060,676 to Hearn et al., all of which are incorporated by reference herein. Many of these types of smoking articles employ a combustible fuel source that is burned to provide an aerosol and/or to heat an aerosol-forming material. See, for example, U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,551,451 to Riggs et al.; U.S. Pat. No. 5,595,577 to Bensalem et al.; U.S. Pat. No. 5,819,751 to Barnes et al.; U.S. Pat. No. 6,089,857 to Matsuura et al.; U.S. Pat. No. 6,095,152 to Beven et al; U.S. Pat. No. 6,578,584 to Beven; and U.S. Pat. No. 6,730,832 to Dominguez; which are incorporated herein by reference. Furthermore, certain types of cigarettes that employ carbonaceous fuel elements have been commercially marketed under the brand names "Premier" and "Eclipse" by R. J. Reynolds Tobacco Company. See, for example, those types of cigarettes described in *Chemical and Biological Studies on New Cigarette Prototypes that Heat Instead of Burn Tobacco*, R. J. Reynolds Tobacco Company Monograph (1988) and Inhalation Toxicology, 12:5, p. 1-58 (2000). Addition types of aerosol-generating devices are described in U.S. Pat. No. 7,726,320 to Robinson et al. and US Pat. Appl. Pub. Nos. 2006/0196518 and 2007/0267031, both to Hon, all of which are incorporated by reference herein.

The powder of the invention can be incorporated into smokeless tobacco products, such as loose moist snuff (e.g., snus), loose dry snuff, chewing tobacco, pelletized tobacco pieces (e.g., having the shapes of pills, tablets, spheres, coins, beads, obloids or beans), extruded or formed tobacco strips, pieces, rods, cylinders or sticks, finely divided ground powders, finely divided or milled agglomerates of powdered pieces and components, flake-like pieces, molded processed tobacco pieces, pieces of tobacco-containing gum, rolls of tape-like films, readily water-dissolvable or water-dispersible films or strips (e.g., US Pat. App. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtonian fluid or a thixotropic fluid incorporating tobacco of some form). Various types of smokeless tobacco products are set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,987,907 to Townsend; U.S. Pat. No. 5,092,352 to Sprinkle, III et al.; and U.S. Pat. No. 5,387,416 to White et al.; US Pat. App. Pub. Nos. 2005/0244521 to Strickland et al. and 2008/0196730 to Engstrom et al.; PCT WO 04/095959 to Arnarp et al.; PCT WO 05/063060 to Atchley et al.; PCT WO 05/016036 to Bjorkholm; and PCT WO 05/041699 to Quinter et al., each of which is incorporated herein by reference. See also, the types of smokeless tobacco formulations, ingredients, and processing methodologies set forth in U.S. Pat. No. 6,953,040 to Atchley et al. and U.S. Pat. No. 7,032,601 to Atchley et al.; US Pat. Appl. Pub. Nos. 2002/0162562 to Williams; 2002/0162563 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0209586 to Neilsen et al.; 2010/0018541 to Gerardi et al.; 2010/0018540 to Doolittle et al.; and 2010/0116281 to Marshall et al., each of which is incorporated herein by reference.

Figure 2:
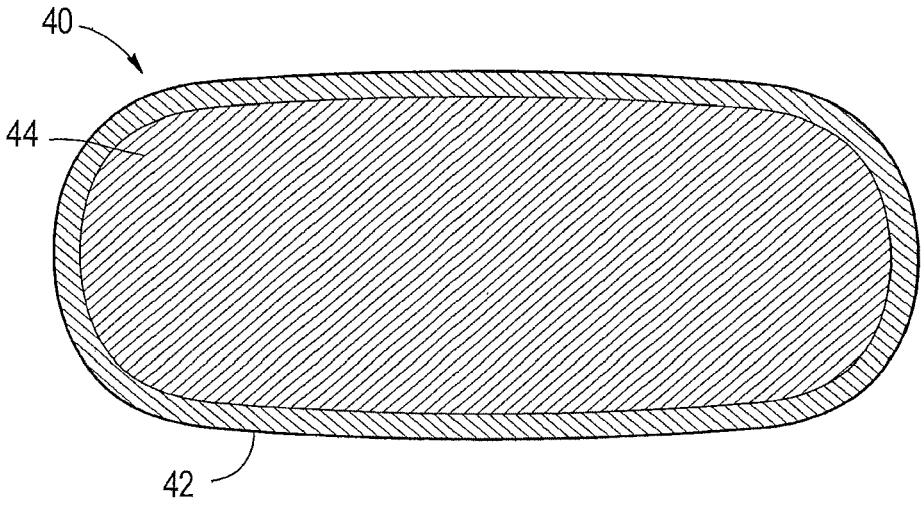
FIG. 2 is a cross-sectional view of a smokeless tobacco product embodiment, taken across the width of the product, showing an outer pouch filled with a smokeless tobacco composition of the invention.

Referring to FIG. 2, a representative snus type of tobacco product comprising the powder of the present invention is shown. In particular, FIG. 2 illustrates a smokeless tobacco product 40 having a water-permeable outer pouch 42 containing a smokeless tobacco composition 44, wherein the tobacco composition includes a shredded or particulate tobacco material serving as a carrier for the powder of the invention.

Many exemplary smokeless tobacco compositions that can benefit from use of the powder of the invention comprise shredded or particulate tobacco material that can serve as a carrier for the flavorful powder of the invention. The smokeless tobacco compositions of the invention can also include a water-soluble polymeric binder material and optionally other ingredients that provide a dissolvable composition that will slowly disintegrate in the oral cavity during use. In certain embodiments, the smokeless tobacco composition can include lipid components that provide a meltable composition that melts (as opposed to merely dissolving) in the oral cavity, such as compositions set forth in U.S. application Ser. No. 12/854,342 to Cantrell et al., filed Aug. 11, 2010, and which is incorporated by reference herein.

In one particular smokeless tobacco product embodiment, the powder of the invention is added to a non-tobacco plant material, such as a plant material selected from potato, beet (e.g., sugar beet), grain, pea, apple, and the like. The non-tobacco plant material can be used in a processed form. In certain preferred embodiments, the non-tobacco plant material can be used in an extracted form, and as such, at least a portion of certain solvent soluble components are removed from that material. The non-tobacco extracted plant material is typically highly extracted, meaning a substantial amount of the aqueous soluble portion of the plant material has been removed. For example, a water-extracted pulp can be obtained by extracting significant amounts of water soluble components from the plant material. For example, certain water-extracted plant materials can comprise less than about 20 weight percent, and often less than about 10 weight percent water soluble components; and depending upon processing conditions, certain water-extracted plant materials can be virtually free of water soluble components (e.g., less than about 1 weight percent water soluble components). One preferred water-extracted plant material is water extracted sugar beet pulp (e.g., water extracted sugar beet leaf pulp). The extracted non-tobacco plant material is typically used in a form that can be described as shredded, ground, granulated, fine particulate, or powder form.

Further additives can be admixed with, or otherwise incorporated within, the smokeless tobacco compositions according to the invention. The additives can be artificial, or can be obtained or derived from herbal or biological sources. Exemplary types of additives include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring and titanium dioxide, and the like), humectants (e.g., glycerin, propylene glycol, and the like), oral care additives (e.g., thyme oil, eucalyptus oil, and zinc), preservatives (e.g., potassium sorbate, and the like), syrups (e.g., honey, high fructose corn syrup, and the like), disintegration aids (e.g., microcrystalline cellulose, croscarmellose sodium, crospovidone, sodium starch glycolate, pregelatinized corn starch, and the like), flavorant and flavoring mixtures, antioxidants, and mixtures thereof. If desired, the additive can be microencapsulated as set forth in US Patent Appl. Pub. No. 2008/0029110 to Dube et al., which is incorporated by reference herein. In addition, exemplary encapsulated additives are described, for example, in WO 2010/132444 A2 to Atchley, which has been previously incorporated by reference herein.

The amount of powder incorporated within a tobacco composition or tobacco product can depend on the desired function of the powder, the chemical makeup of the powder, and the type of tobacco composition to which the powder is added. The amount of powder added to a tobacco composition can vary, but will typically not exceed about 5 weight percent based on the total dry weight of the tobacco composition to which the powder is added. For example, the amount of powder added to a tobacco composition can be in the range of about 0.25 to about 5 weight percent based on the total dry weight of the tobacco composition.

EXPERIMENTAL

Aspects of the present invention are more fully illustrated by the following examples, which are set forth to illustrate certain aspects of the present invention and are not to be construed as limiting thereof.

Georgia flue-cured tobacco stalks (~1,000 lbs) and tobacco roots (~1,000 lbs) are harvested, washed, fumigated, and dried. The dried materials are ground to a relatively fine powder. For analysis, powders prepared from tobacco stalks, big root, mid root, and small root are kept separated.

A sample (~2 g) of each powder (i.e., powder prepared from tobacco stalk, powder prepared from big root, powder prepared from mid root, and powder prepared from small root) is added to a microwave permeable vessel. Water (~50 mL) is added to each powder sample. A CEM microwave set to 200° C. for 2 h is employed to heat the samples. However, the maximum temperature reached is 150° C. at about 50 minutes into the heating process.

After 2 h, the samples are cooled, filtered using filter paper and a water aspirator, and further purified by centrifugation at 1700 rpm for 15 minutes to remove additional water insoluble material. The supernatant is concentrated by allowing water to evaporate slowly in an oven set at 80° C. The solids in powder form thus obtained are black to dark brown in color and have a pleasant aroma reminiscent of sugar-ammonia or caramelization chemistry. The percentage of extract collected from the stalk or root material subjected to extraction is about 20 percent on average, based on the total weight of the material subjected to extraction.

The samples are dissolved in acetone using sonication, filtered, and analyzed using GC-MS (e.g., using an Agilent 6890 GC). The total ion chromatograms reveal that the acetone extracts contain nicotine and relatively small amounts of additional volatile components such as 3-hydroxypyridine, furufals, and Vitamin E. The surprising presence of vanillin and syringaldehyde in the total ion chromatograms indicate the presence of a lignin degradation reaction pathway during the preparation of the extracts.

Selected ion monitoring (SIM) is also used to analyze the samples. A SIM table constructed of the ions attributable to pyrazine and alkyl substituted pyrazines is built and applied to the analysis of the samples. The SIM chromatograms show the presence of trace levels of methylpyrazine and C2 pyrazine. These results indicate that Maillard and/or sugar/nitrogen reactions occur during the extraction process.

To assess the nature of the volatile components contributing to the positive aroma of the powder material resulting from the extraction process, headspace/microextraction/gas chromatography/mass spectrometry experiments are conducted using solid phase microextraction (SPME) fibers (75 μm Carboxen PDMS fibers or 65 μm PDMS DVB fibers), with a fiber adsorption time of 30 minutes and a desorption time of 3 minutes. Total ion chromatograms of the headspace above each heat-treated material reveal the presence of multiple volatile compounds. The headspace above the stalk-derived material is more abundant in volatile material than the headspace above the root-derived material. The headspace above the stalk-derived material is dominated by aldehydes, with a small contribution from nicotine and vanillin. Additional exemplary components confirmed from the headspace experiment on the stalk-derived material include C2 and C3 pyrazines, acetic acid, dihydro-2-methyl-3-furanone, furanethanolacetate, furanmethanol, maltol, 3-hydroxypyridine, and 5-methylfurfural. The headspace above the root-derived material is primarily nicotine with significant contributions from volatile sugar thermal degradation compounds and minor contributions from pyrazines and vanillin. Additional exemplary components confirmed form the headspace experiment on the root-derived material include hexanal, pentylfuran, nonanal, decanal, menthol, 3-methylpentanoic acid, 2-hydroxy-3-methyl-2-cyclopenten-1-one, 3-hydroxypyridine, and 2,6-dimethoxyphenol.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method for preparing a flavorful composition from the stalk or roots of a plant of the *Nicotiana* species, comprising:

i) receiving a particulate tobacco material comprising at least about 90 percent by dry weight of at least one of the stalk material and the root material of a harvested plant of the *Nicotiana* species;

ii) extracting water-soluble components from the particulate tobacco material to form an aqueous extract, wherein the extracting comprises contacting the particulate tobacco material with an aqueous solvent to form a moist tobacco material, heating the moist tobacco material at an elevated temperature, and separating the aqueous extract from an insoluble portion of the moist tobacco material; and iii) concentrating the aqueous extract to provide a flavorful tobacco composition suitable for use as in a tobacco product, wherein the flavorful tobacco composition comprises at least one compound selected from vanillin and syringaldehyde.

2. The method of claim 1, wherein the particulate tobacco material comprises tobacco stalk material or tobacco root material separated from the remainder of the tobacco plant.

3. The method of claim 1, wherein the received particulate tobacco material is formed by grinding at least one of the stalk material and the root material of a harvested plant of the *Nicotiana* species to form a particulate material.

4. The method of claim 1, wherein the extracting step is conducted at a pressure exceeding atmospheric pressure.

5. The method of claim 1, wherein the concentrating step comprises heating the aqueous extract.

6. The method of claim 1, wherein the extracting step comprises filtering the aqueous extract to remove insoluble solid components of the particulate tobacco material.

7. The method of claim 6, wherein the filtering comprises exposing the aqueous extract to an ultrafiltration membrane.

8. The method of claim 1, further comprising adding the aqueous extract to a tobacco material or a non-tobacco plant material as a carrier for the aqueous extract.

9. The method of claim 8, further comprising incorporating the tobacco material or non-tobacco plant material carrying the aqueous extract into a tobacco product.

10. The method of claim 9, wherein the tobacco product is in the form of a smokeless tobacco composition.

11. The method of claim 10, wherein the form of smokeless tobacco composition is selected from the group consisting of moist snuff, dry snuff, chewing tobacco, tobacco-containing gums, and dissolvable or meltable tobacco products.

12. The method of claim 9, wherein the tobacco product is in the form of a smoking article.

13. The method of claim 12, wherein the smoking article comprises a casing formulation or a top dressing comprising the extract.

14. A method for preparing a flavorful composition from the stalk or roots of a plant of the *Nicotiana* species, comprising:

i) receiving a particulate tobacco material comprising at least about 90 percent by dry weight of at least one of the stalk material and the root material of a harvested plant of the *Nicotiana* species;

ii) mixing an aqueous solvent with the particulate tobacco material to form a moist tobacco material;

iii) heating the moist tobacco material to an elevated temperature to extract flavorful components therefrom;

iv) separating an aqueous-insoluble portion of the moist tobacco material to form an isolated aqueous extract; and v) concentrating the aqueous extract to provide a flavorful tobacco composition suitable for use as in a tobacco product wherein the flavorful tobacco composition comprises at least one compound selected from vanillin and syringaldehyde.

15. The method of claim 14, wherein the concentrating step comprises evaporating sufficient aqueous solvent to form a solid material suitable for incorporation into a tobacco product in powder form.

16. The method of claim 14, wherein the received particulate tobacco material is formed by grinding at least one of the stalk material and the root material of a harvested plant of the *Nicotiana* species to form a particulate material.

17. The method of claim 14, wherein the moist tobacco material is in the form of a slurry or suspension.

18. The method of claim 14, wherein the heating step is conducted at a temperature of at least about 50° C.

19. The method of claim 14, wherein the separating step comprises at least one of filtration and centrifugation.

* * * * *